United States Patent [19]

Unsworth

[11] Patent Number: 5,023,964

[45] Date of Patent: Jun. 18, 1991

[54] SHOWER CURTAIN RETAINER

[76] Inventor: John Unsworth, Ste. 211, 14525 - 92 Street, Edmonton, Alberta, Canada, T5E 3S7

[21] Appl. No.: 470,232

[22] Filed: Jan. 25, 1990

[30] Foreign Application Priority Data

Jan. 25, 1989 [CA] Canada ..... 589113

[51] Int. Cl.[5] ..... A47K 3/22

[52] U.S. Cl. ..... 4/558; 4/608; 160/DIG. 6; 160/DIG. 13

[58] Field of Search ..... 4/558, 597, 605, 607, 4/608, 609, 610; 160/349.2, DIG. 13, DIG. 6

[56] References Cited

U.S. PATENT DOCUMENTS

| | | | |
|---|---|---|---|
| 1,518,943 | 12/1924 | Story | 160/DIG. 13 |
| 2,049,061 | 7/1936 | Hoegger, Sr. | 4/609 X |
| 2,148,401 | 2/1939 | Ellis, Jr. | 4/608 X |
| 2,302,502 | 12/1942 | Rous | 4/608 X |
| 2,712,354 | 7/1955 | Margolies | 4/608 X |
| 2,764,382 | 9/1956 | Gubernick | 160/349.2 |
| 3,050,742 | 8/1962 | Munson | 4/608 X |
| 3,879,806 | 4/1975 | Armstrong | 4/610 |
| 4,070,735 | 1/1978 | Canaday | 160/DIG. 6 |
| 4,594,741 | 6/1986 | Payne | 4/558 |
| 4,726,411 | 2/1988 | Conley | 160/392 |
| 4,759,087 | 7/1988 | Zeilinger | 4/605 |
| 4,887,324 | 12/1989 | Cairns | 4/609 |

FOREIGN PATENT DOCUMENTS

| | | | |
|---|---|---|---|
| 960956 | 1/1975 | Canada . | |
| 997670 | 9/1976 | Canada . | |
| 333569 | 9/1989 | European Pat. Off. | 4/605 |
| 3046583 | 7/1982 | Fed. Rep. of Germany | 4/610 |

*Primary Examiner*—Henry J. Recla
*Assistant Examiner*—Robert M. Fetsuga
*Attorney, Agent, or Firm*—Anthony R. Lambert

[57] ABSTRACT

A shower curtain retainer for maintaining a shower curtain in the closed position includes an elongated arcuate handle with a socket extending the entire length of one side thereof for receiving lugs on a plurality of connectors. A side edge of a shower curtain is retained in the socket by the lugs. A suction cup is provided on at least one of the connectors for connecting the handle and the shower curtain to the wall of the shower.

4 Claims, 5 Drawing Sheets

SHOWER CURTAIN RETAINER

FIELD OF INVENTION

This invention relates to a shower curtain retainer device, and in particular to a device for retaining a shower curtain in the closed position.

BACKGROUND OF THE INVENTION

Shower curtain edge holders are not new. Examples o of such holders are described in Canadian Patents Nos. 960,956, issued to R. E. White on Jan. 14, 1975 and 997,670, issued to H. P. Armstrong on Sep. 28, 1976. While the patented holders are effective, they require elements permanently affixed to the ends of the shower enclosure. The use of such elements makes cleaning somewhat difficult. Moreover, at least one of the patented devices is somewhat complicated structurally, and thus expensive to produce and difficult to use and install.

The object of the present invention is to solve the problems of existing shower curtain holders by providing a relatively simple, easy to install and operate shower curtain retainer.

SUMMARY OF THE INVENTION

Accordingly, the present invention relates to a retainer device for holding a shower curtain in the closed position comprising handle means for mounting on one end of a shower curtain for manually moving the curtain between open and closed positions, coupler means releasably connected to said handle means for connecting said one end of the shower curtain to said handle means, and for releasably connecting said handle means and consequently said one end of the shower curtain to an end of a shower enclosure.

BRIEF DESCRIPTION OF THE DRAWINGS

The invention will be described with reference to the accompanying drawings, which illustrate a preferred embodiment of the invention; and wherein:

With reference to FIG. 1, the retainer device of the present invention which is generally indicated at 1 is intended for use on one end 2 of a shower curtain 3. The shower curtain 3 is slidably mounted on a conventional bar or rod 5 which extends between the ends 6 (one shown) of a shower enclosure—in this case a bathtub 7. As best shown in FIG. 2, the principal elements of the invention include a handle 8 for mounting on the ends 2 of the shower curtain 3, and channel members 10 and 11 for connecting the handle 8 to the shower curtain 3, and for connecting the handle 8 to the end of the shower enclosure.

Referring to FIGS. 3 to 5, the handle 8 is defined by a one-piece plastic body, which includes a large loop 12 facilitating manual engagement of the handle and a Y-shaped side 13 defined by a pair of resilient outwardly diverging arms 15 for receiving the channel members 10 and 11. The arms 5 are arcuate, diverging outwardly, and then converging to define a socket in the form of a generally V-shaped recess with a narrow mouth for receiving an elongated lug 16 (FIGS. 6, 8, 9 and 10) on the channel members 10 and 11. The outer ends of the arms 15 are defined by flaring flanges 18 for facilitating insertion of the lug 16.

Figure 6:
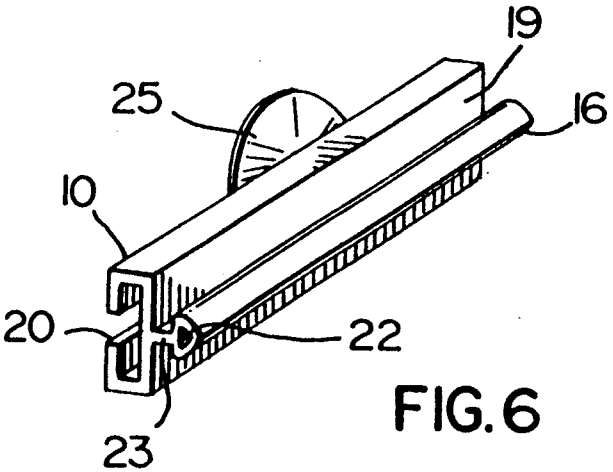
FIG. 6, which appears on the first sheet of drawings, is a perspective view from one end of a coupler used in the device of FIG. 2.
Figure 7:
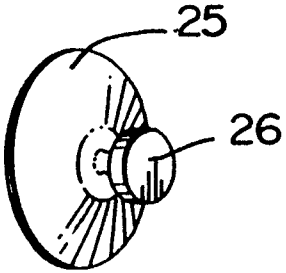
FIG. 7, which appears on the first sheet of drawings, is a perspective view of a suction cup used in the coupler of FIG. 6.
Figure 1:
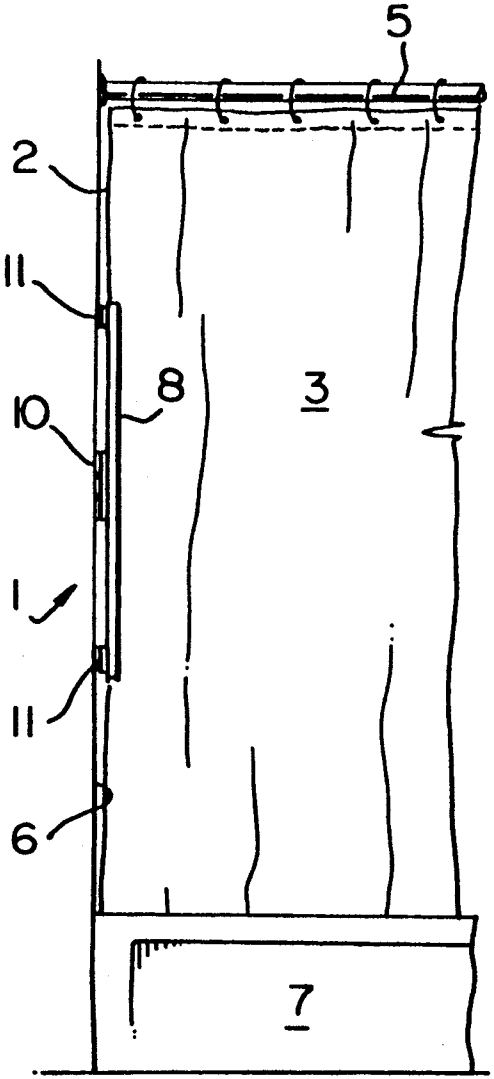
FIG. 1 is a schematic front view of one end of a shower curtain with a retainer device in accordance with the present invention attached thereto.
Figure 2:
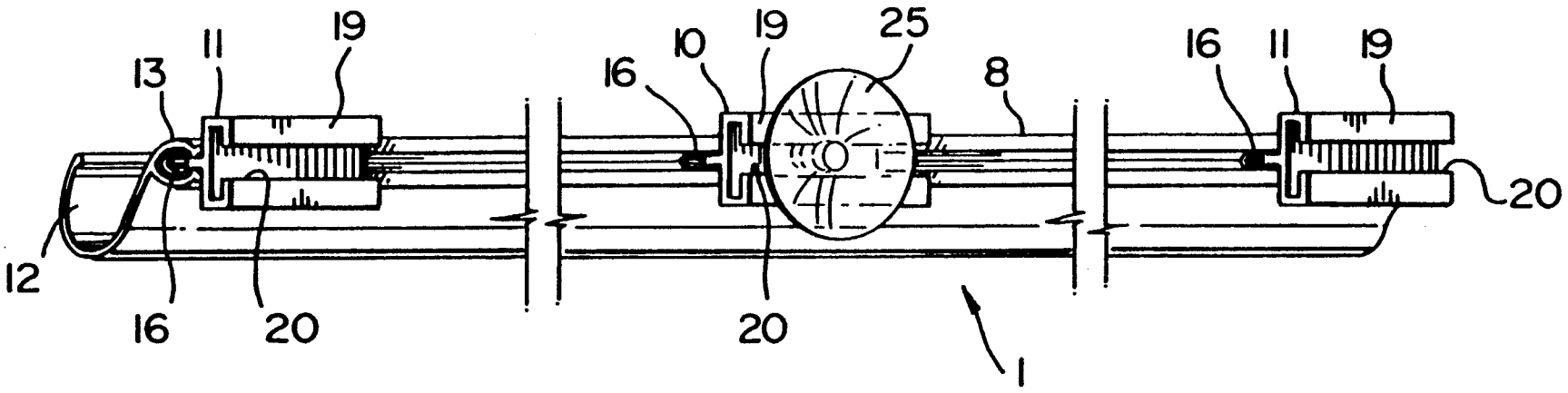
FIG. 2 is a perspective view from one end of the device of FIG. 1.

Each of the channel members 10 and 11 is defined by one elongated body 19 of the rectangular cross section, with a slot 20 in one side thereof. The lug 16 extends longitudinally of the body 19 along the entire length thereof. The lug 16 includes a generally triangular head 22 connected to the body 19 by a thinner web 23 of plastic. A suction cup 25 (FIGS. 6 and 7) is provided in the centre of the body 19 of the channel member 10 for connecting the latter and consequently the shower curtain 3 to the end 6 of the bathtub 3. A disc-shaped lug 26 is provided on the suction cup 25 for mounting the suction cup in the body 19. The lug 26 is slid into one end of the body 19. An alternate arrangement (FIG. 8) is to provide a lug 28 on the suction cup 25, i.e. to make the channel member and suction cup a single unitary coupler although as noted below, the preferred arrangement is to omit the channel member altogether and use the suction cup 25 alone. In this alternative, the lug 28 is elongated and is connected to the suction cup 25 by a thin arm 29.

Figure 9:
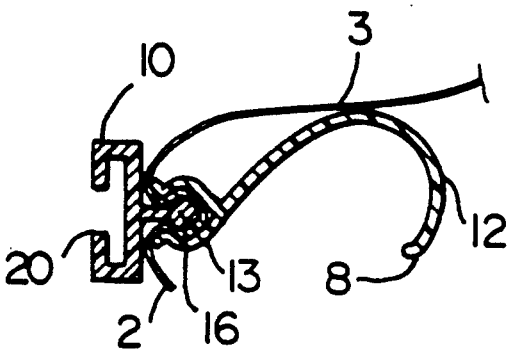
FIG. 9 is a cross section of a handle and channel member coupled to a shower curtain according to one embodiment of the present invention.

Referring to FIG. 9, the device of the present invention is connected to the ends 2 of the shower curtain 3 by placing the curtain over the socket or recess between the arms 15 of the side 18 of the handle 8, and snapping the lugs 16 of the channel members 10 and 11 into such recess. The two ends 2 of the curtain 3 are connected to the shower enclosure by means of the suction cups 25. During normal use, one of the ends 2 of the shower curtain remains more or less permanently affixed to the end 6 of the shower enclosure. The other end 2 of the curtain is disconnected and re-connected simply by grasping the handle 8 and pulling or pushing to release or engage the suction cup 25.

Figure 10:
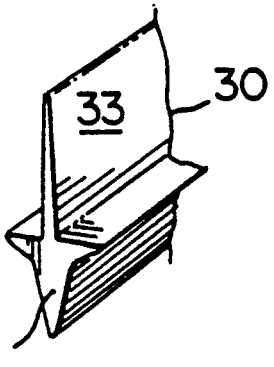
FIG. 10 is a perspective view of one end of a seal used in the device of FIG. 1.

With the device in place, a gap still exists between the device and the end 6 of the shower enclosure, except in the area of the channel members 10 and 11. The gap can be closed by means of a flexible seal 30 (FIG. 10). The seal 30 includes a lanceolate lug 31 extending the length thereof for mounting the seal in the body 8 between the channel members 10 and 11, and an outwardly tapering body 33 integral with the lug 31 for closing the gap. Such a seal 30 can extend upwardly and downwardly beyond the ends of the retainer device for closing a portion of the gaps remaining between the ends of the shower curtain and the ends 6 of the enclosure.

It will be appreciated that a single channel member 10 with one or more suction cups 25 can be used instead of the channel members 10 and 11. Alternatively, a plurality of couplers 10 can be used. Moreover, the device can be used at the centre of the curtain ends (as shown) or at other locations along the length thereof.

In the claims, it will be understood that coupling means includes either the connection of the channel members 10 or 11 with the suction cup 25, or simply the suction cup 25 alone (although, as it appears below, preferably with the sealing barrier 30 or 40).

Figure 5:
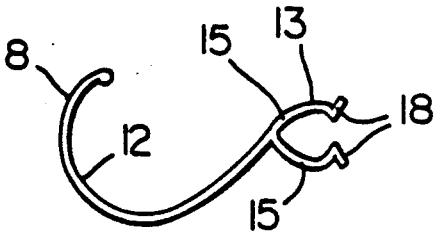
FIG. 5 is an end view of the handle of FIGS. 3 and 4.
Figure 4:
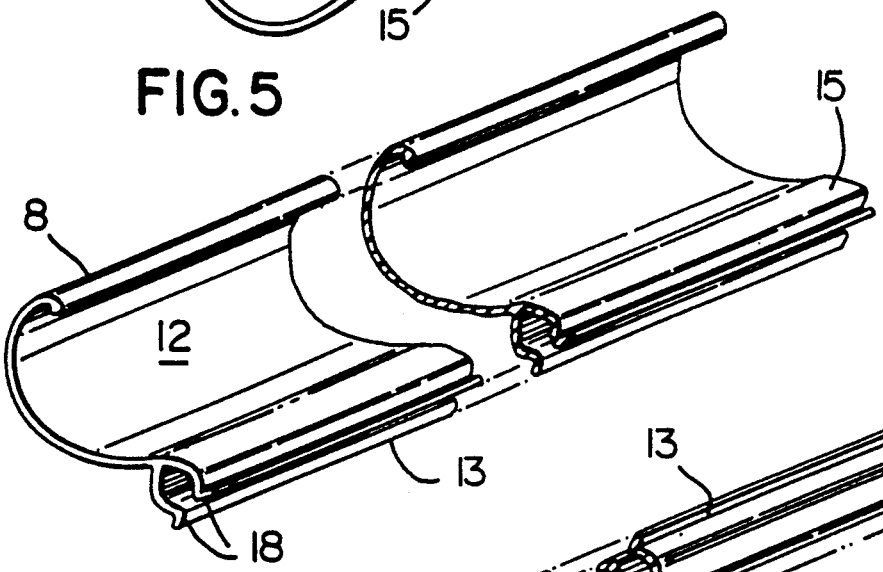
FIGS. 3 and 4 are perspective views of a handle used in the device of FIGS. 1 and 2.
Figure 3:
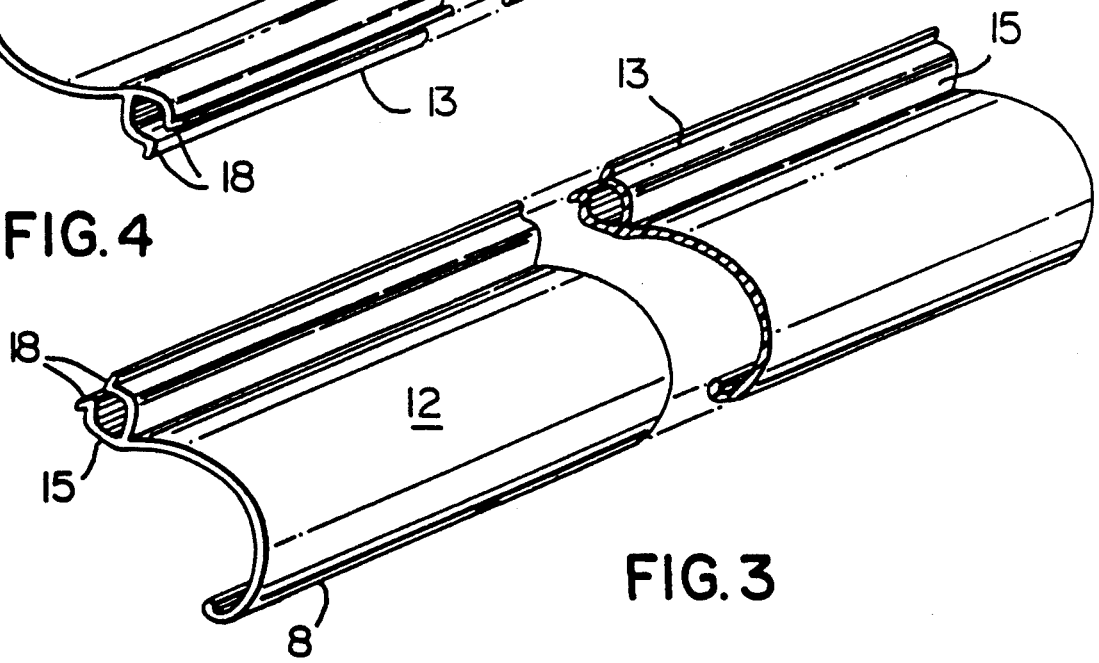
Figure 11:
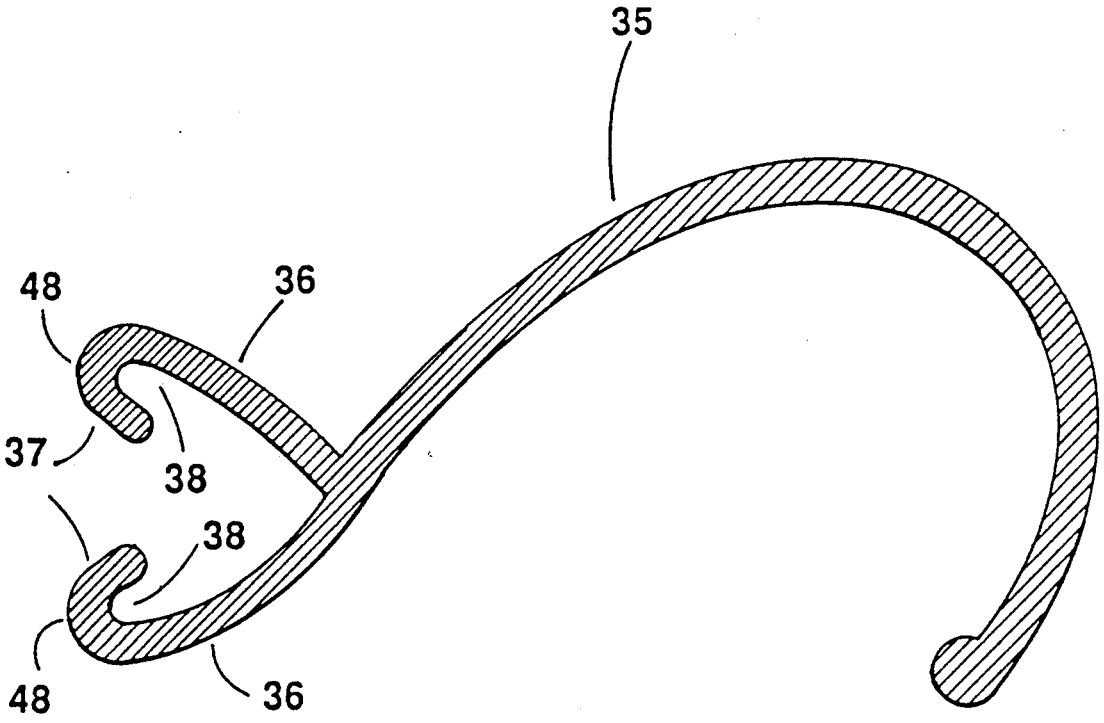
FIG. 11 shows a cross-section of an alternate embodiment of the handle shown in FIG. 5.

Referring to FIG. 11, there is shown a modified and preferred form of the handle 8 shown in FIG. 5. In FIG. 11, the diverging arms 36 of handle 35 terminate in inwardly turned flanges 37 forming bight portions 38. As compared with the arms 15 shown in FIG. 5, the arms 36 are longer to provide greater flexibility, which permits (a) the easy insertion of the sealing barrier 30 shown in FIG. 10 or (b) the easy insertion of the sealing barrier 40 shown in FIG. 12 as described in more detail below or (c) the easy insertion of suction cup 25. The turning of the arms 36 to form the flanges 37, and the length of the flanges 37, helps the lug 41 described below or the lug 28 on the suction cup 25 to spread the arms 36 on insertion.

The arms 36 are thickened at the curve 48 forming the deepest part of the bight portion, that is, furthest from the junction of the arms 36. This thickened portion forms a rigid barrier against which the sealing barrier 30 or 40 may be placed. The handle 35 is preferably made of rigid PVC, commonly commercially available. The design of the arms 36 results in the arms 36 converging as a result of an outward force on the arms 36, as for example when the lug 28 on the suction cup 25 is being pulled out of the arms 36 when the handle is being pulled to remove the suction cup 25 from a shower enclosure. This converging of the arms 36 helps increase the grip of the arms 36 on the lug 28.

Figure 12:
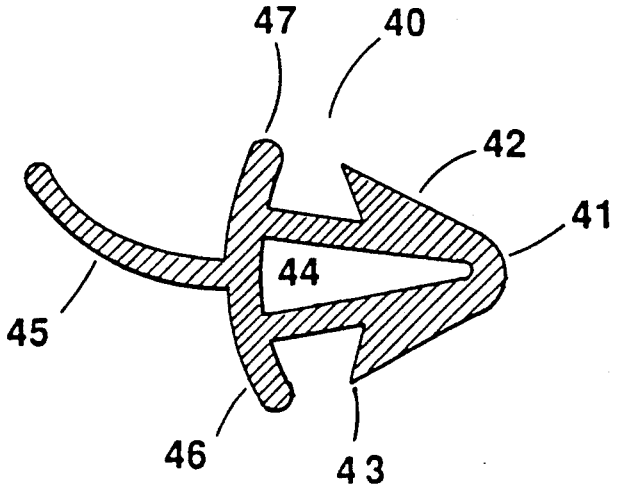
FIG. 12 shows a cross-section of an alternative embodiment of the sealing barrier shown in FIG. 10.

Referring to FIG. 12, there is shown a cross-section of an alternative and preferred form of the sealing barrier 30 shown in FIG. 10. In FIG. 12, the sealing barrier 40 includes a lug 41 having inclined edges 42 terminating in shoulders 43. The interior 44 of the lug 41 is hollow to allow for easy compressibility. A curved and flexible body 45 extends away from the base 46 of the lug 41. The sealing barrier 40 is preferably made of PVC flex, commonly commercially available, and this permits the body 45 to flex against a wall of a shower enclosure to provide a fluid tight connection. The base 46 extends laterally on either side of the sealing barrier 40, to allow for easy installation of the sealing barrier 40 between the arms 36 of handle 35. The flexibility of the sealing barrier 40 helps prevent tearing of curtains on connection and disconnection of the handle 35 to the sealing barrier 40.

For installation, the lug 41 is pressed between the arms 36 by pressure on the base 46. The bight portions 38 receive the shoulders 43. Collapsing of the interior 44 of the lug 41 allows for easy insertion of the lug 41. By suitable design of the base 46, upon insertion, the tips 47 of the base contact the outer edges 48 of the flanges 37 to provide a seal. This seal helps prevent dirt, bacteria, mildew, etc. from entering the connection between the lug 41 and the handle 35.

Figure 8:
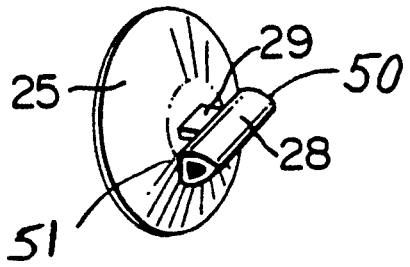
FIG. 8 is a perspective view of a second form of coupler for use in the device of FIG. 2.

The sealing barrier 40 preferably extends along the length of the handle 35, except for a small area which receives the suction cup 25 shown in FIG. 8.

The hollow interior 44 of the lug 41 allows the sealing barrier 40 to accommodate different thicknesses of shower curtains using the method of installation shown in FIG. 9 as applied to the suction cup 25 shown in FIG. 8, rather than the channel member. The curved body 45 of the sealing barrier 40 eliminates the necessity of providing considerable force to achieve an effective seal against a shower wall. The resistance of the lug 41 to the collapsing of the interior of the lug 41 upon insertion of the lug 41 between the arms 36 of a handle 35 helps prevent the unit from sliding down a shower curtain.

The collapsibility of the interior 44 of the lug 41 facilitates simple insertion, and upon insertion allows expansion to provide a secure connection.

Referring to FIG. 8, the preferred embodiment of suction cup 25 is made of PVC vinyl, and should have a relatively thick connector 29 to prevent accidental ripping of the connector 29, and a relatively sharper angle of the inclined edges 50 than shown, together with a broader shoulder 51. The soft material helps prevent accidental ripping of curtains on connection of the suction cup 25 to the handle 35, while allowing various thicknesses of curtains to be gripped by the handle 35 and suction cup 25. Note that in this preferred embodiment, the suction cup 25 is connected directly to the handle 35, and the lug 28 on the suction cup 25 is made more or less complimentary to the shape of the diverging arms 36 of handle 35. The sharper angle of the inclined edges 50 make the suction cup 25 easier to insert into the handle 35. The increased width provided by the shoulders 51 provide a greater gripping force to secure a shower curtain in place and prevents the suction cup 25 from popping out when pulled on. In FIG. 8, the length of the lug 28 along the retainer should preferably be in the order of ½, rather than as shown (about 1").

The suction cup 25 is preferably made with a solid lug 28 to prevent it from being accidentally released from the handle 35 when the retainer is being taken off a shower curtain enclosure. In addition, the suction cup 25 may be made integral with the sealing barrier 40, having a similar lug as on the sealing barrier 40, except for the lug being solid. It will be appreciated that a balance need be made between the extra gripping force to prevent the suction cup 25 accidentally being released from the handle 35, and risk of tearing the curtain on assembly (since the lug 28 of the suction cup 25 needs to be pushed with some force between the diverging arms of the handle). The balance is believed to be made by using a suction cup 25 as described here made of PVC vinyl and a rigid handle 35 as shown in FIG. 12.

The present construction provides a unique configuration of handle and suction cup, and together with the sealing barrier, the suction cup neatly holds the curtain in the handle. This enables the retainer device to be very simple, yet strong, easy to use, and applicable to various curtain thicknesses and to both sides of a shower enclosure.

However, while use of the suction cup 25 has utility for smooth shower walls, the suction cup is not suitable for use with some shower walls having rough surfaces. In the case of shower walls having rough surfaces, it is preferable to use a relatively flat plate (not shown) having a smooth surface on one side and an adhesive backing on the other. The adhesive backing can be applied to the wall, while the suction cup is applied to the plate. For example, such a backing plate could be made from a 3 ½ inch PVC disc with an adhesive backing.

I claim:

1. A retainer device for holding a shower curtain in the closed position against the wall of a shower enclosure, the device comprising:

coupler means having first and second opposing sides, the first side including a suction cup and the second side including first lug means;

a longitudinally elongate sealing barrier having third and fourth opposing sides, the third side including a flexible curved body and the fourth side including second lug means extending transversely away from the body; and a longitudinally elongate and transversely arcuate handle having a first side and a second side, the first side defining socket means for releasably receiving both the first lug means and the second lug means together with the shower curtain, the second side defining said handle;

whereby the shower curtain is releasably connectable between the coupler means and the handle, and the coupler means and therefore the shower curtain are releasably connectable to the wall.

2. The retainer device of claim 1 in which the socket means includes a pair of resilient arms extending away from the handle and includes a pair of resilient arms extending away from the handle and defining a generally V-shaped recess for receiving the first lug means.

3. The retainer device of claim 2 in which each arm of the pair of resilient arms has a distal end, and each distal end curves inwardly to form a pair of opposing bight portions; and each of the first lug means and second lug means include a pair of shoulders adapted to be received by the bight portions of the resilient arms.

4. The retainer device of claim 3 in which the flexible curved body of the sealing barrier and the second lug means are separated by a laterally extending base which, upon connection of the coupler means to the socket means, abuts against the pair of resilient arms in sealing engagement.

* * * * *